United States Patent [19]

Arai

[11] Patent Number: 5,016,060

[45] Date of Patent: May 14, 1991

[54] PAPER TRANSPORTING DEVICE FOR AN IMAGE RECORDER HAVING GUIDE RIBS ON A TRANSPORT SURFACE

[75] Inventor: Yukiyoshi Arai, Yokohama, Japan

[73] Assignee: Ricoh Company, Ltd., Tokyo, Japan

[21] Appl. No.: 411,834

[22] Filed: Sep. 25, 1989

[30] Foreign Application Priority Data

Sep. 27, 1988 [JP] Japan ..... 63-125170[U]

[51] Int. Cl.[5] ..... G03G 21/00

[52] U.S. Cl. ..... 355/312; 271/188; 271/194; 271/900

[58] Field of Search ..... 355/315, 312; 271/900, 271/310, 307, 309, 188, 209, 194

[56] References Cited

U.S. PATENT DOCUMENTS

| | | | |
|---|---|---|---|
| 3,395,610 | 9/1968 | Evans et al. | 355/312 X |
| 3,674,257 | 7/1972 | Neeb et al. | 271/194 X |
| 4,320,952 | 3/1982 | Seimiya et al. | 355/312 |
| 4,478,506 | 10/1984 | Miyoshi et al. | 355/315 X |

FOREIGN PATENT DOCUMENTS

| | | | |
|---|---|---|---|
| 0004077 | 1/1982 | Japan | 355/315 |

*Primary Examiner*—A. T. Grimley

*Assistant Examiner*—Nestor R. Ramirez

*Attorney, Agent, or Firm*—Oblon, Spivak, McClelland, Maier & Neustadt

[57] ABSTRACT

A paper transporting device for an image recorder for transporting, after a visible image formed on the surface of an image carrier by an electrophotographic procedure has been transferred to a paper sheet by an image transferring device, the paper sheet separated from the image carrier to a fixing device by orienting one surface of the paper sheet carrying the visible image downward and by sucking the other surface by a suction source. A guide member has a transport surface for transporting the paper sheet while guiding it. A number of holes for suction are formed through the transport surface. A plurality of guide ribs protrude from the transport surface. The holes are positioned at opposite sides and in close proximity to the guide ribs. A ground plate covers the entire transport surface and is connected to ground. During transport, the paper sheet slides on and along the edges of the ribs while being spaced apart from the transport surface at opposite sides of the guide ribs. The holes of the transport surface are so positioned as to align with the spaced portions of the paper sheet and, so long as the paper sheet has ordinary elasticity, they are prevented from being stopped up by the paper sheet.

7 Claims, 4 Drawing Sheets

PAPER TRANSPORTING DEVICE FOR AN IMAGE RECORDER HAVING GUIDE RIBS ON A TRANSPORT SURFACE

BACKGROUND OF THE INVENTION

The present invention relates to a paper transporting device for an image recorder and, more particularly, to a paper transporting device of the type causing a toner image to be transferred to a paper sheet in an upper portion of a photoconductive element of an image recorder and then transporting the paper sheet face down to a fixing unit.

In a laser printer, electrophotographic copier, facsimile machine or similar image recorder implemented with a dry process electrophotographic procedure, a toner image formed on a photoconductive element is transferred to a paper sheet, and then the paper sheet is separated from the photoconductive element. The paper sheet carrying the toner image thereon is transported to a fixing unit for fixing the toner image. With a laser printer which belongs to a family of image recorders of the type described, it is not necessary to lay an original document on a glass platen for reproduction. Hence, an optical writing station for writing data in a photoconductive element can be readily provided below the photoconductive element, in turn allowing a toner image to be transferred to a paper sheet in a position above the photoconductive element. When imagewise transfer is performed over a photoconductive element as stated, it is possible to provide a linear paper transport path in the image recorder and to stack paper sheets face down one upon another, i.e., in order of page. Further, such a configuration allows a jamming sheet to be removed with ease and eliminates an occurrence that toner particles drop onto a paper sheet. With these advantages in view, there has been proposed a paper transport system of the type transporting a paper sheet face down above a photoconductive element, allowing a toner image to be transferred to the paper sheet in a position above the photoconductive element, and then transporting the paper sheet face down to a fixing unit.

The above-described type of paper transport system, however, has some problems left unsolved. Specifically, the photoconductive element is spaced apart from the fixing unit by a certain distance so as to protect the former against heat which the latter generates. This, coupled with the fact that a toner image is simply electrostatically deposited on the underside of a paper sheet before the latter reaches the fixing unit, it is not desirable to guide a paper sheet by a guide member of the kind making direct contact with the underside of a paper sheet. A sufficiently thick or sufficiently elastic paper sheet would be successfully transported as far as the fixing unit without the need for such a guide member. However, a majority of paper sheets usable with an image recorder does not have such a thickness or elasticity. Specifically, a paper sheet is usually sustained in a cantilever fashion before its leading edge reaches a fixing roller of the fixing unit or after its trailing edge has been separated from the photoconductive element. In this condition, an ordinary paper sheet necessarily bends downward due to gravity resulting in the leading edge thereof missing the fixing roller or in an image portion adjacent to the trailing edge rubbing against another member. In the light of this, a number of holes may be provided above a paper transport path in order to cause a fan to suck a paper sheet from above during the transport of the paper sheet, as already proposed in the art.

However, a prior art paper transporting device adopting the above-mentioned suction scheme is not satisfactory for the following reasons. Since a paper sheet is transported while being sucked from above through the number of holes, once it stops up the holes with its upper surface, not only the load acting on the fan but also the intensity of vacuum are increased. The intensified vacuum sucks the paper sheet strongly against the holes and thereby increases the resistance to the sliding movement of the paper sheet on and along a guide member which is formed with the holes. Furthermore, the holes are apt to catch the corners of the leading edge of a paper sheet having a particular size, bending them or causing the paper sheet to jam the transport path.

SUMMARY OF THE INVENTION

It is therefore an object of the present invention to provide a paper transporting device for an image recorder which transports a paper sheet surely and stably.

It is another object of the present invention to provide a paper transporting device for an image recorder which prevents a suction force acting through holes formed through a paper transport surface from increasing to an unusual degree and eliminates bends of a paper sheet and paper jams ascribable to the suction which tends to draw the corners of a paper sheet into the holes.

It is another object of the present invention to provide a generally improved paper transporting device for an image recorder.

In accordance with the present invention, in a paper transporting device for an image recorder for transporting, after a visible image formed on the surface of an image carrier by an electrophotographic procedure has been transferred to a paper sheet by an image transferring device, the paper sheet separated from the image carrier to a fixing device by orienting one surface of the paper sheet carrying the visible image downward and by sucking the other surface by a suction source, a body is located above the image carrier and image transferring device. A guide member is provided on the underside of the body and has a transport surface for transporting the paper sheet. A number of holes are formed through the transport surface of the guide member for sucking the paper sheet by the suction of the suction source. A plurality of guide rib members protrude from the transport surface for guiding the paper sheet. The number of holes are positioned at opposite sides and in close proximity to the plurality of guide ribs.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
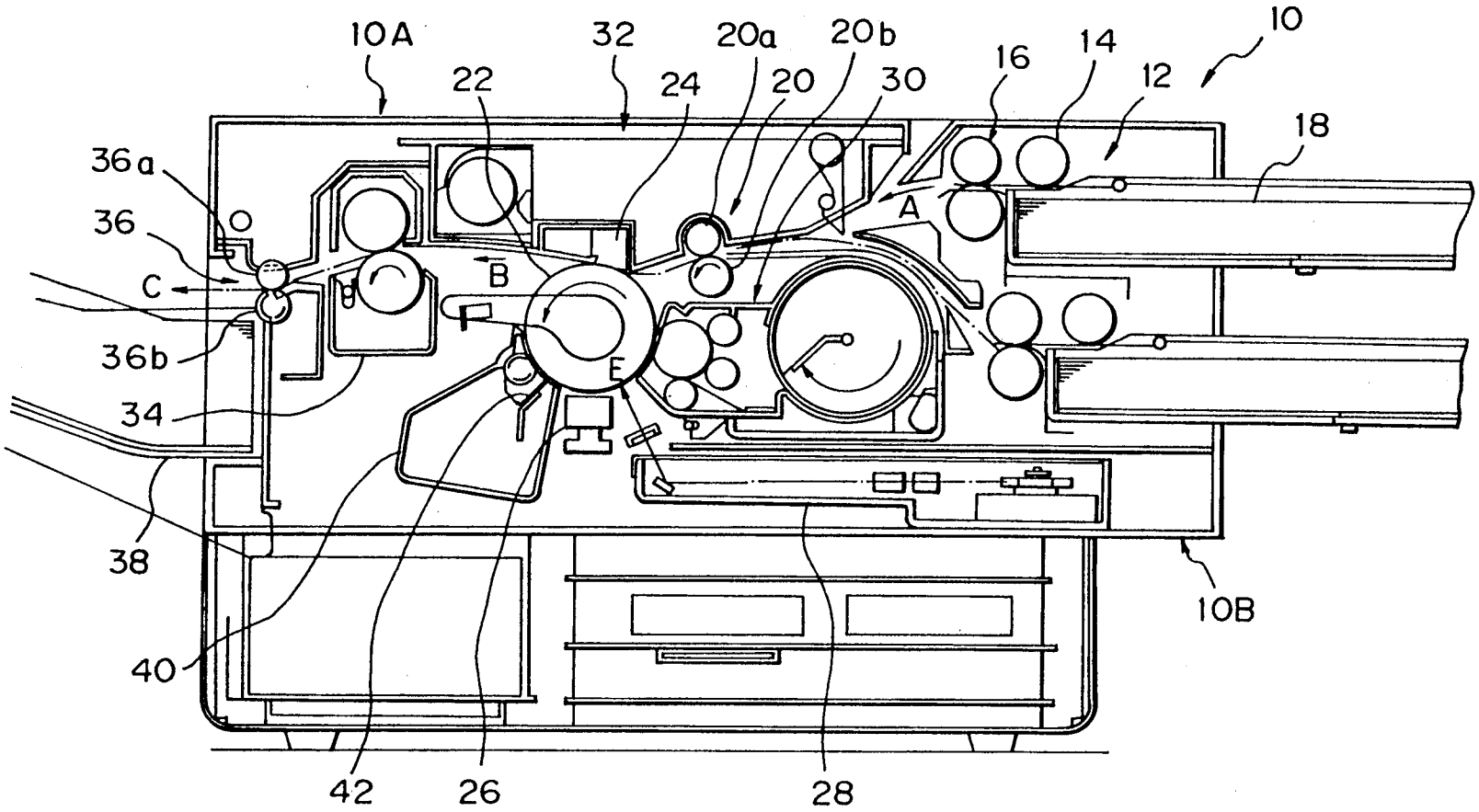
FIG. 1 is a sectional side elevation of a laser printer belonging to a family of image recorders to which the present invention is applicable.

Referring to FIG. 1 of the drawings, a laser printer to which the present invention is applicable is shown and generally designated by the reference numeral 10. As shown, the laser printer 10 has a paper feeder 12 which includes a pull-out roller 14 and a feed roller pair 16. A paper sheet 18 driven out of the paper feeder 12 by the rollers 14 and 16 in a direction A reaches a register roller pair 20 which is made up of an upper register roller 20*a* and a lower register roller 20*b*. At a predetermined timing, the register roller pair 20 drives the paper sheet 18 to between a photoconductive element 22 and a transfer charger 24 which is located above the drum 22 and constitutes an image transferring device.

A main charger 26 is located below the drum 22. Laser optics 28 and a developing device 30 are positioned between the main charger 26 and the transfer charger 24 and in this order with respect to the direction of rotation of the drum 22 which is indicated by an arrow in the figure. The laser optics 28 scans the drum 22 at a predetermined imagewise exposure station E. A toner image formed on the drum 22 by such process devices is transferred to the paper sheet 18 by the transfer charger 24. The paper sheet 18 carrying the toner image thereon is separated from the drum 22. A suction type paper transporting device 32 of the present invention transports the paper sheet 18 which carries the toner image thereon to a fixing device 34 as indicated by an arrow B. During the transport, the transporting device 32 exerts a suction force on the back or non-image surface of the paper sheet 18 and, even when the paper sheet 18 is brought into a cantilevered state as previously discussed, prevents its leading edge or trailing edge from bending downward. After the toner image has been fixed on the paper sheet 18 by the fixing device 34, the paper sheet 18 is further fed by a discharge roller pair 36 which is made up of an upper discharge roller 36*a* and a lower discharge roller 36*b* in a direction C. Finally, the paper sheet, or copy, 18 is driven out of the printer onto a copy tray 38. Toner particles remaining on the drum 22 after the image transfer are removed by a cleaning device 40 having a cleaning blade 42. The removed toner particles are collected in a toner tank 44.

The laser printer 10 has an upper unit 10A which is hinged to a lower unit 10B by a shaft 46, as shown at the left-hand side of FIG. 1. The upper unit 10A is constituted by that part of the printer 10 which is disposed above th paper transport path A-B-C except for the paper feeder 12 and fixing device 34. The lower unit 10B is constituted by the other part of the printer 10. The upper unit 10A may be swung away from the lower unit 10B to a wide-open position. Incorporated in the upper unit 10A are the upper register roller 20*a*, transfer and separation charger 24, transporting device 32, and upper discharge roller 36*a*.

Figure 2:
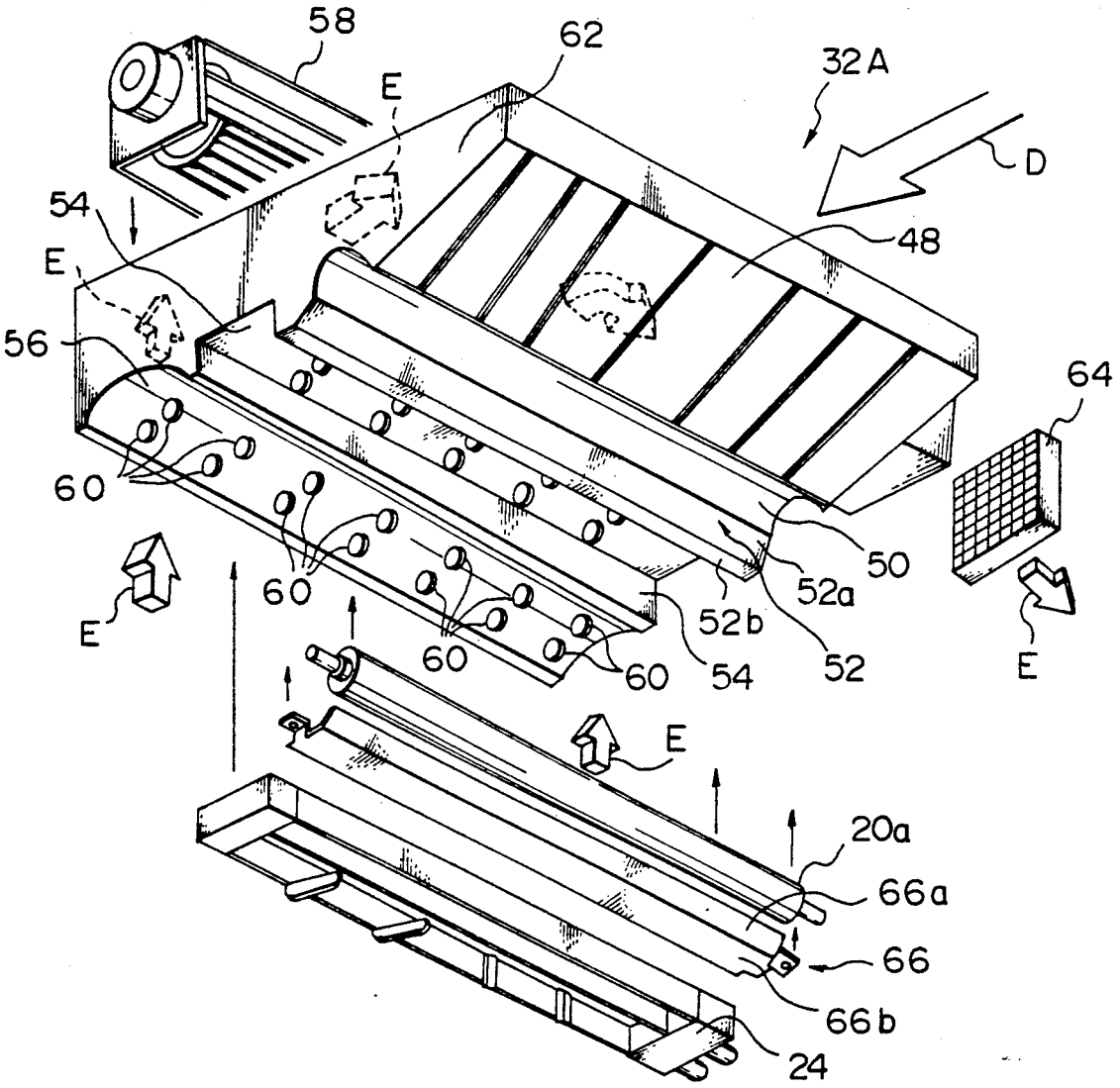
Fig. 2 PRIOR ART
FIGS. 2 and 3 are views showing the construction and operation of a prior art suction type paper transporting device installed in the laser printer of FIG. 1.

To better understand the transport device 32 of the present invention, a brief reference will be made to a prior art suction type transporting device, shown in FIGS. 2 and 3. The prior art transporting device, generally 32A, is configured as a generally hermetically closed box which is integral with a cover of the upper unit 10A. The transporting device 32A has on its underside a preregister upper guide surface 48, a recess 50 for accommodating the upper register roller 20*a*, an upper guide member 52 having pretransfer upper guide surfaces 52*a* and 52*b*, a recess 54 for receiving the transfer and separation charger 24, and a paper transport surface 56 for transporting a separated paper sheet. The surface 48, recess 50, member 52, recess 54 and surface 56 are arranged in this sequence with respect to an intended direction of paper transport D. A fan 58 is disposed in the transporting device 32A in such a manner as to overly the paper transport surface 56 over the entire width of the latter, while the surface 56 is provided with a number of holes 60. The fan 58 sucks air through the holes 60 and discharges it to the outside of the transporting device 32A via the recesses 50 and 54, a duct 62 defined above the preregister upper guide surface 48, and a grill 64 mounted on one side of the device 32A, as indicated by arrows E in FIG. 2. A lower guide member 66 has pretransfer lower guide surfaces 66*a* and 66*b* and is mounted outwardly of the pretransfer upper guide surfaces 52*a* and 52*b* with the intermediary of a paper transport path.

Figure 3:
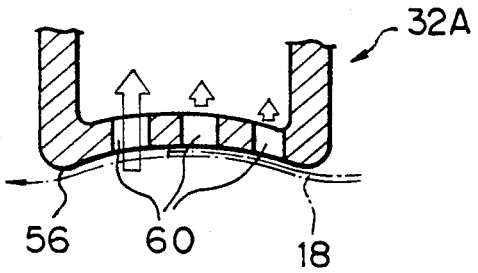
Fig. 3 PRIOR ART

As stated above, the prior art transporting device 32A transports the paper sheet 18 while maintaining the upper surface of the latter in contact with the transport surface 56 which is formed with the number of holes 60, as shown in FIG. 3. Hence, once the paper sheet 18 stops up the holes 60 with its upper surface, the vacuum prevailing in the duct 62 defined above the transport surface 56 is intensified to suck the paper sheet 18 strongly against the surface 56 and thereby increases the resistance to the sliding movement of the paper sheet 18. Furthermore, the holes 60 are apt to catch the corners of the leading edge of the paper sheet 18 having a particular size, bending them or causing the paper sheet 18 to jam the transport path.

The transporting device 32 of the present invention constitutes an improvement over the prior art transporting device 32A and is free from the above-discussed drawbacks.

Figure 4:
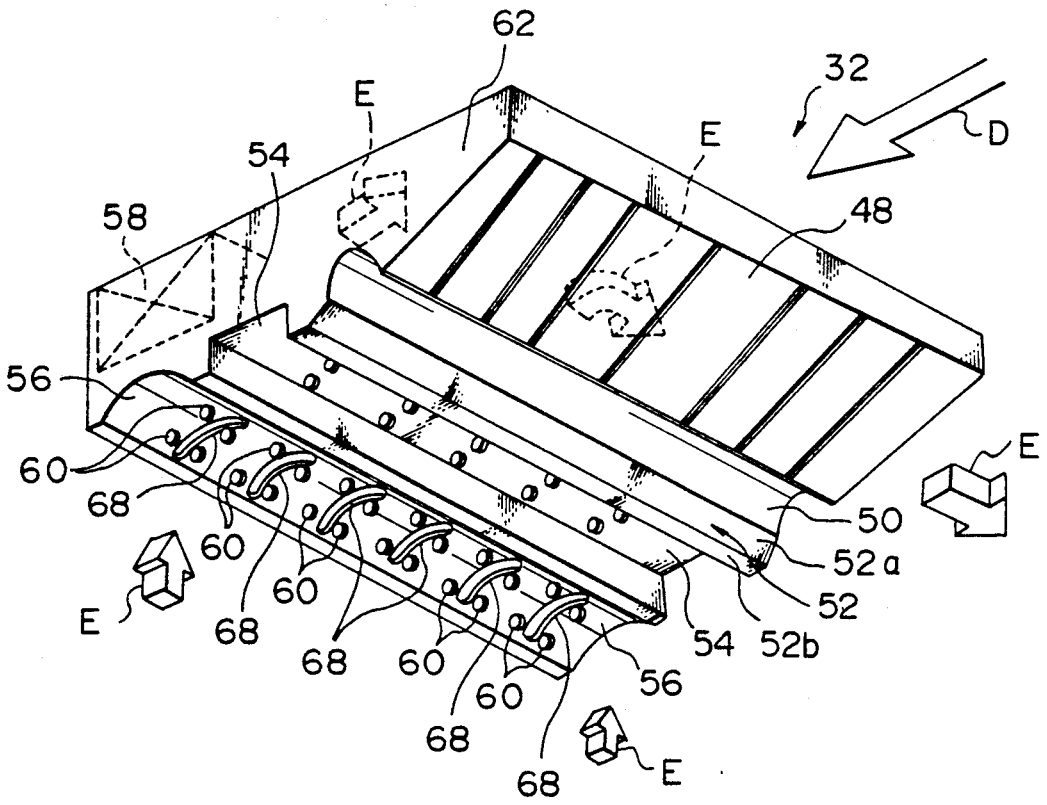
FIGS. 4 to 6 are views showing the construction and operation of a suction type paper transporting device embodying the present invention and also installed in the laser printer of FIG. 1.
Figure 5:
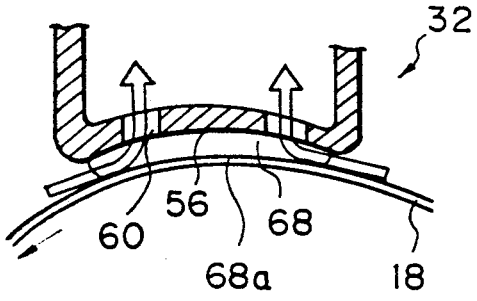
Figure 6:
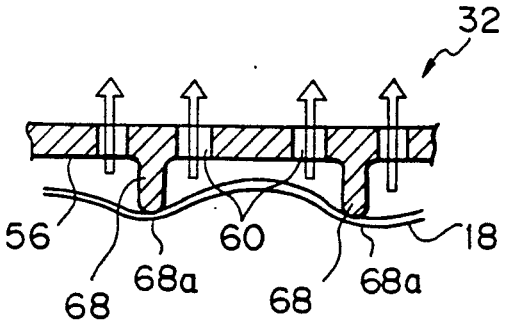

Referring to FIG. 4, a preferred embodiment of the paper transporting device 32 in accordance with the present invention is shown. The device 32 is different from the prior art device 32A in that it has a plurality of ribs 68 extending on the transport surface 56 in the paper transport direction D. The holes 60 for suction are positioned at opposite sides and in close proximity to the individual ribs 68. The rest of the construction is essentially similar to that of the prior art device 32A, and similar components and structural elements are designated by the same reference numerals. FIGS. 5 and 6 show the transport surface 56 and the paper sheet 18 being transported therealong in a section parallel to the paper transport direction and a section perpendicular thereto, respectively. When the device 32 transports the paper sheet 18 while maintaining its upper surface in sliding contact with the edges 68*a* of the ribs 68, the paper sheet 18 is drawn by suction toward the surface 56 in between the nearby ribs 68. However, since the holes 60 are located in close proximity to the bases of the ribs 68, an ordinary paper sheet will not stop up the holes 60 due to its inherent elasticity. This prevents the vacuum inside the duct 62 from being intensified to in turn increase the suction force, i.e., frictional resistance. Even when either one of opposite side edges of the paper sheet 18 is aligned with any of the holes 60, its corner will be prevented from being drawn into the hole 60 and thereby bending the corner of the paper sheet 18 or causing a jam.

Figure 7:
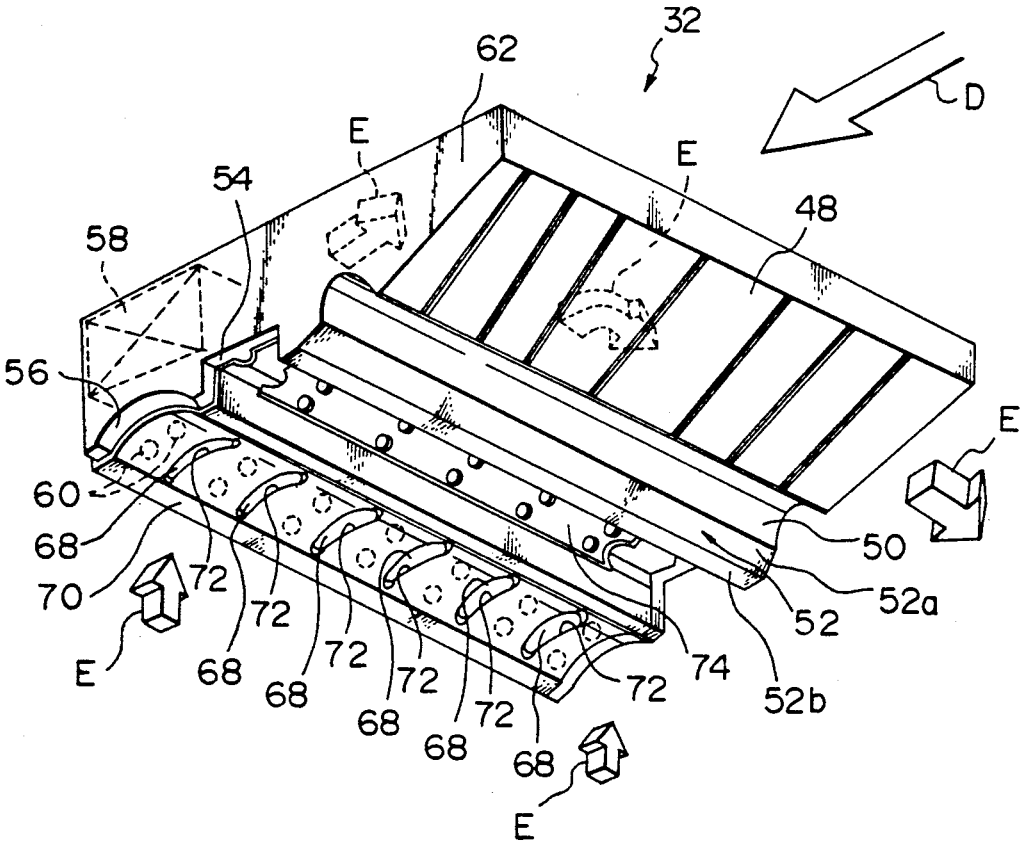
FIGS. 7 to 9 are views showing an alternative embodiment of the present invention.
Figure 8:
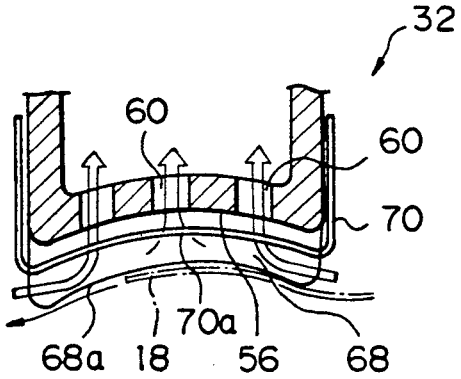
Figure 9:
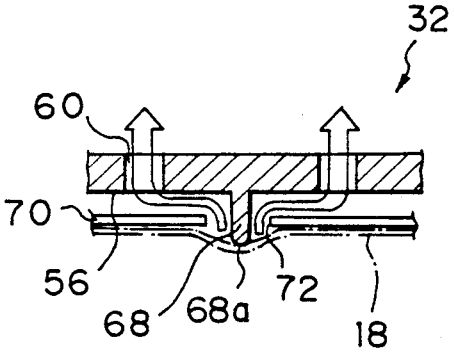

Referring to FIGS. 7, 8 and 9, an alternative embodiment of the present invention is shown. The alternative embodiment is the same as the previous embodiment in that it has ribs 68 on the transport surface 56. In this particular embodiment, a ground plate 70 is positioned at a predetermined distance from the transport surface 56 while covering the entire transport surface 56. The ground plate 70 has slots 72 which correspond in position to the ribs 68 on the transport surface 56. Specifically, the ribs 68 individually extend throughout the slots 72 with some allowance. The ground plate 70 is held in a predetermined position by a fixing member 74 which is made of metal. The fixing member 74 is located in an end portion with respect to the widthwise direction and fixed in place by being resiliently received in the recess 54, which is adapted for the transfer and separation charger 24. In this configuration, the paper sheet 18 is transported along the edges 68*a* of the ribs 68 and the outer surface 70*a* of the ground plate 70. A stream of air is routed through the gaps between the slots 72 of the ground plate 70 and the ribs 68, the clearance between the ground plate 70 and the transport surface 56 and the holes 60 to the duct 62. This is successful in preventing the paper sheet 18 from sopping up the gaps between the ribs 68 and the slots 72 or being caught by the holes 60, as with the previous embodiment. In addition, since the ground plate 70 is connected to ground via the fixing member 74, charging due to the friction between the transport surface 56 and the paper sheet 18 is eliminated even if the transporting device 32 is made of plastics or similar non-conductive material.

In summary, it will be seen that the present invention provides a paper transporting device which, while transporting a paper sheet undergone image transfer face down and by sucking its upper surface, eliminates an increase in the frictional resistance between a transport surface having suction holes and the paper sheet ascribable to an increase in suction force, as well as a jam otherwise caused by the suction holes which are apt to catch the corners of the paper sheet.

Various modifications will become possible for those skilled in the art after receiving the teachings of the present disclosure without departing from the scope thereof.

What is claimed is:

1. A paper transporting device for an image recorder for transporting, after a visible image formed on a surface of an image carrier by an electrophotographic procedure has been transferred to a paper sheet by an image transferring device, said paper sheet separated from said image carrier to a fixing device by orienting one surface of said paper sheet carrying said visible image downward and by sucking the other surface of said paper sheet by sucking means, said device comprising:

a body located above the image carrier and the image transferring device;

a guide member provided on an underside of said body and having a transport surface for transporting the paper sheet;

a number of holes formed through said transport surface of said guide member for sucking the paper sheet by suction of said sucking means; and a plurality of guide rib members protruding from said transport surface for guiding the paper sheet, said number of holes being positioned at opposite sides and in close proximity to said plurality of guide ribs;

wherein said plurality of guide ribs prevent an increase of suction through said holes and thereby prevent an increase in frictional resistance between the transport surface having said holes and said paper sheet.

2. A device as claimed in claim 1, wherein said body comprises a duct formed therein.

3. A device as claimed in claim 1, wherein said guide rib members individually extend in an intended direction of paper transport.

4. A device as claimed in claim 1, further comprising a ground member connected to a grounded surface and located at a predetermined distance from said transport surface while covering said transport surface entirely.

5. A device as claimed in claim 4, wherein said ground member has a plurality of slots through each of which respective one of said guide rib members extends.

6. A paper transporting device for an image recorder for transporting, after a visible image formed on a surface of an image carrier by an electrophotographic procedure has been transferred to a paper sheet by an image transferring device, said paper sheet separated from said image carrier to a fixing device by orienting one surface of said paper sheet carrying said visible image downward and by sucking the other surface of said paper sheet by sucking means, said device comprising:

a body located above the image carrier and the image transferring device;

a guide member provided on an underside of said body and having a transport surface for transporting the paper sheet;

a number of holes formed through said transport surface of said guide member for sucking the paper sheet by suction of said sucking means;

a plurality of guide rib members protruding from said transport surface for guiding the paper sheet, said number of holes being positioned at opposite sides and in close proximity to said plurality of guide ribs; and a ground member connected to a grounded surface and located at a predetermined distance from said transport surface while covering said transport surface entirely.

7. A device as claimed in claim 6, wherein said ground member has a plurality of slots through each of which respective one of said guide rib members extends.

* * * * *